US005301952A

United States Patent [19]

Fitzgerald

[11] Patent Number: 5,301,952

[45] Date of Patent: Apr. 12, 1994

[54] GAME APPARATUS

[76] Inventor: Stanley E. Fitzgerald, 40 Fairview Ave., Sellersville, Pa. 18960

[21] Appl. No.: 972,649

[22] Filed: Nov. 6, 1992

[51] Int. Cl.[5] ..... A63F 9/04

[52] U.S. Cl. ..... 273/269; 273/264

[58] Field of Search ..... 273/146, 264, 268, 269, 273/271

[56] References Cited

U.S. PATENT DOCUMENTS

| | | | |
|---|---|---|---|
| 2,871,581 | 2/1959 | Guzak | 273/146 X |
| 3,659,851 | 5/1972 | Lang et al. | 273/271 |
| 4,015,850 | 4/1977 | Russell | 273/146 X |
| 4,720,108 | 1/1988 | Gramera | 273/271 X |
| 4,743,025 | 5/1988 | Gramera | 273/146 X |
| 4,900,034 | 2/1990 | Bereuter | 273/146 X |

*Primary Examiner*—Vincent Millin
*Assistant Examiner*—William M. Pierce

[57] ABSTRACT

A game apparatus for alternative participation by a plurality of players using a pair of dice, markers, and a game card formed into intersecting columns, rows, and diagonal locations. A game object requires that any row, column, or diagonal locations be appropriately designated with markers upon a series of throws of the dice; and, a winner is determined by the first player to complete a required number of such locations each one of which has an assigned value for calculating a score.

7 Claims, 3 Drawing Sheets

10

| 30 | 15 | 50 | 16 | 17 | 13 | 18 | 19 | 20 | 21 |
|---|---|---|---|---|---|---|---|---|---|
| 31 | 1 | | 2 | 3 | | 4 | 5 | 6 | 210 |
| 22 1 | 30 | | 31 | 32 | | 33 | 34 | 35 | 195 |
| 23 2 | 31 | | 32 | 33 | | 34 | 35 | 36 | 201 |
| 24 3 | 32 | 14 | 33 | 34 | 39 | 35 | 36 | 37 | 207 |
| 25 4 | 33 | | 34 | 35 | | 36 | 37 | 38 | 213 |
| 26 5 | 34 | | 35 | 36 | | 37 | 38 | 39 | 219 |
| 27 6 | 35 | | 36 | 37 | | 38 | 39 | 40 | 225 |
| 28 | 195 | | 201 | 207 | | 213 | 219 | 225 | 210 |

40

GAME APPARATUS

BACKGROUND OF THE INVENTION

Field of the Invention

The invention relates in general to a game apparatus for use by two or more individuals who alternate in active participation. in particular, the invention relates to a game for use by at least two players where dice are thrown to fill certain spaces upon a play board.

In known prior art games where a pair of dice are utilized by the participants in an alternate play mode and, where markers and numbers are placed upon a play board in certain spaces comprising rows, columns, and diagonals of a checkerboard-like game board, no showing has been found that demonstrates a relationship between the board numbers with the numbers on the side faces of the dice. Furthermore, there are no known games in the marketplace or prior art where a winner's score is determined by a summation of the above mentioned board numbers with the first player to fill rows, columns, or diagonals with markers after a series of thrown dice has been executed.

SUMMARY OF THE INVENTION

The invention relates to a game apparatus for recreational activity that utilizes an appropriately divided checkerboard-like game board in conjunction with a pair of dice and markers. The purpose of the apparatus is for any one of a plurality of players to Complete a game by filling a predetermined number of row, column, and diagonal spaces with markers as the dice are alternately thrown by any of the participants.

The up faces of the thrown dice locate the markers on the row, column, and diagonal spaces on the play board and the summation of the numbers in the locations comprising the completed spaces determine the total score achieved. Several games may be played to produce a predetermined grand score total.

The basic structure of the game design permits numerous optional variations such that interest may be maintained after playing several rounds of the same game. One variation of the game apparatus of this invention requires that the rows and columns comprising the outside perimeter of the play board be completed with markers for a participant to win the game. In another variation, the game may be played such that only diagonals may be completed with markers. In these game variations, the score is determined upon a game completion by summing the preassigned numbers assigned to each space upon which a marker is located.

It is therefore an object of the invention to provide a new and improved game apparatus for two or more persons.

It is a further object of the invention to furnish a game apparatus which is adapted to be played in different formats using dice, markers, divided checkerboard-like play card where values are assigned that relate to the dice faces.

DESCRIPTION OF THE PREFERRED EMBODIMENT

Figure 1:
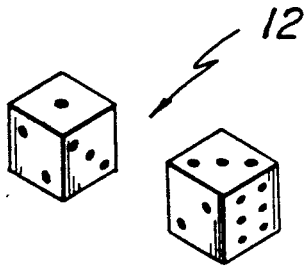
FIG. 1 is a plan view of the play board of the invention which is divided into row, column, and diagonal locations and a front elevational view of a pair of dice and markers as used with the play of the game to complete the various locations.
Figure 1:
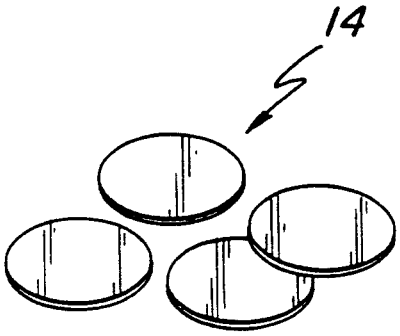

Referring now to the drawings and in particular to FIG. 1 there is depicted a play card or board 10 which is divided into rows 22 to 27 and columns 15 to 20; and, each area of the rows and columns is designated, for example, as space 50. The divided game board 10 includes six basic rows and columns which are identified by an appropriate single digit in row 30 and column 40. The row and column identifiers aid the player in locating particular spaces on the board 10 as will become apparent upon further discussion hereinbelow. The game apparatus of the invention further includes a pair of dice 12 and a plurality of markers 14. The dice are thrown alternately by each player and markers 14 are positioned on the appropriate spaces 50 of the play board 10.

It is noted that each space 50 of the play board 10 includes a numeric in the form of an indicia that is consecutively located across row 22, for example. The numbered indicia in the upper left space corresponding to the intersection of row 1, column 1 is thirty. This number is derived by adding all of the digits of the pair of dice when the up faces are both one which correspond to row 1, column 1. The sum of the dice faces under this circumstance is the number thirty as indicated. As may be readily seen, each adjacent consecutive space beginning with space 50 increases by one numerical count until the indicia thirty-five is reached. The number thirty-two by way of further example is derived by positioning the up faces of a pair of dice 12 with the one and three digits facing upwardly and then adding all of the digits upon the remaining visible faces. The number thirty-two is therefore located in column three, row one.

In column 21 and row 28, there are located a plurality of numbers that represent the summation of a particular row and column. The column 21 and opposite row 22, for example, the indicia 195 is indicated which represents the summation of all of the numbers in the above-mentioned row. Similarly, in row 28, the number indicia 207 is located under column three. As above stated, this indicia represents the summation of all of the numbers in column three. It should also be noted that at the top of and bottom of column 21 the number 210 with a slanted arrow is depicted. The indicia 210 represents the numerical summation of either diagonal each of which includes six spaces 50.

The instant game may be played by a plurality of players where the minimum number is two. Each player is required to use at least one play card 10 for which a plurality of markers 14 is furnished; in addition, a one pair of dice 12 is supplied which may be utilized by all of the players.

The strategy of the game employing the game apparatus 10, 12, 14 requires that any player complete any row, column, or diagonal with the placement of markers that totals three; or in other words, any three completed columns or rows would satisfy this requirement as well as any combination of three where columns, rows, and diagonals are mixed. As an example, the first player to satisfy the completion of two diagonals and one row or, one diagonal, one row and one column would be declared a winner. The score that the winner achieved would be the summation of the total scores for the particular rows, columns, or diagonals that were filled with markers. The game disclosed herein may be structured so that the winner would be determined by achieving a grand total score of, for example, one-thousand. In that event, a series of plays would be required where the winning score of each game would be cumulative. In this arrangement, the loser would be allowed to accumulate a score for any completed columns, rows, or diagonals.

The markers 14 are positioned by the particular players on the various spaces 50 by the numbers produced by a throw of the dice 12. As an illustration, if a one and three were thrown by a particular player in the manner shown in FIG. 1, markers 13, 14 would be respectively positioned at the intersections of column one and row three as well as column three and row one. However, if identical numbers such as one, one and three, three were thrown by a player, only one space 50, namely, the intersection of row one and column one and the intersection of row three, column three would receive respective markers (dotted) 31, 39. In the event that doubles are thrown by the player, another turn is allowed.

Figure 2:
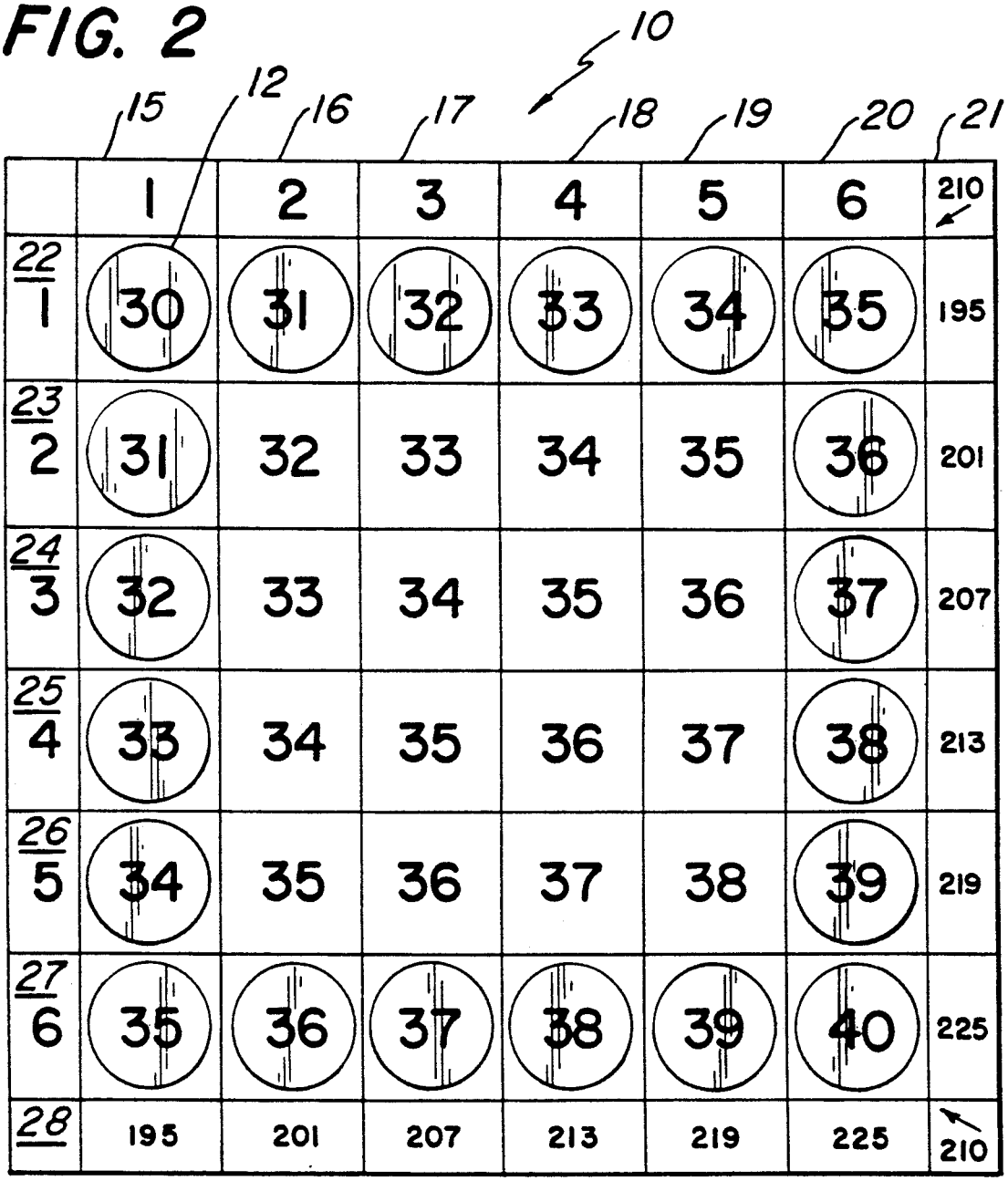
FIG. 2 is another plan view of the game board of the invention wherein a variation of the game of FIG. 1 is depicted.

Another embodiment of the invention is illustrated in FIG. 2 where the perimeter columns and rows only are completed with the various markers 12. In all other respects, the game 10 is played in the same manner as above described except that the score total achieved by a player only relate to the outside columns and rows. In this form of the game play, the loser may receive the score total of the rows and columns that have been completed.

Figure 3:
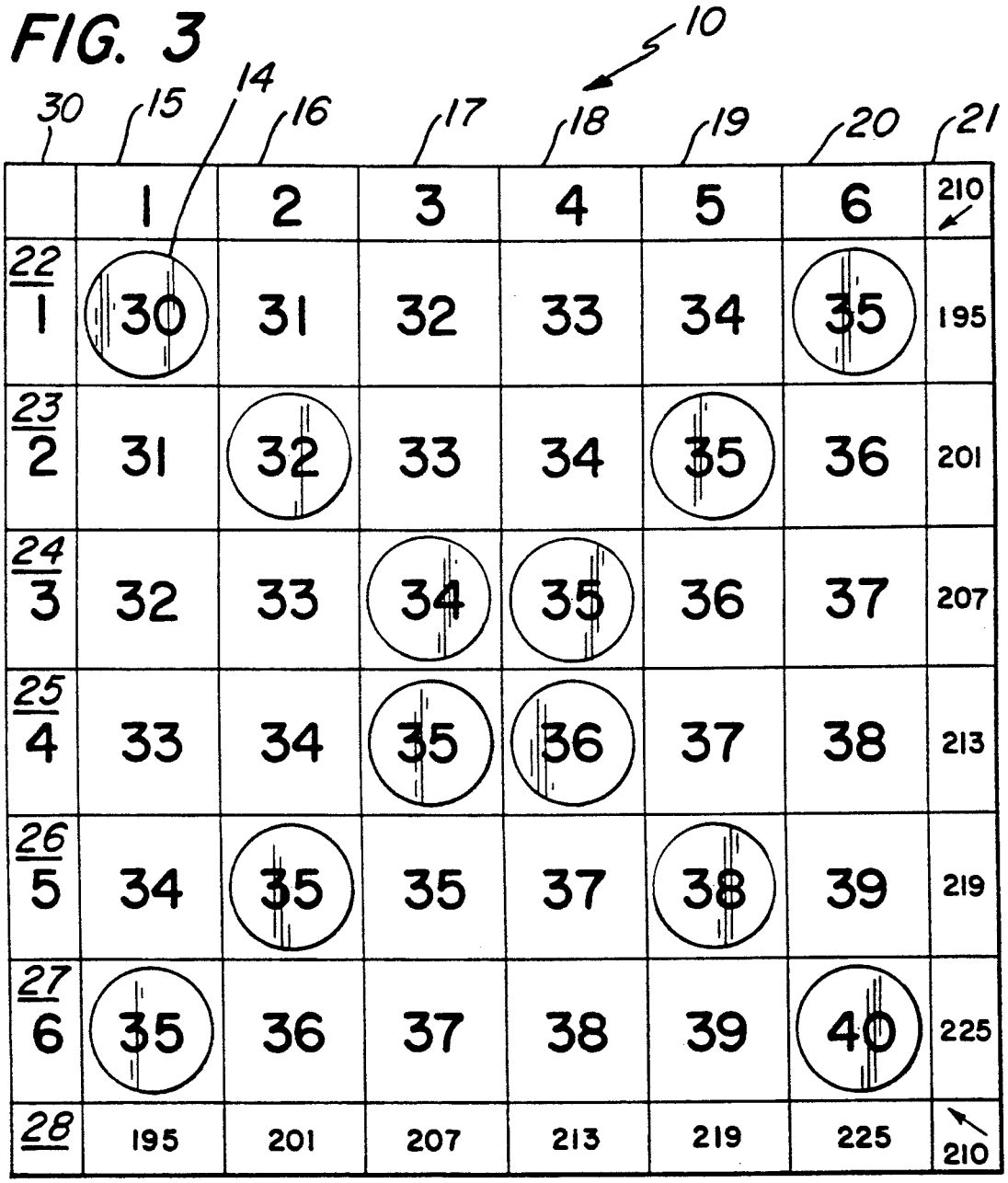
FIG. 3 is another plan of the game board of the invention wherein still another variation of the game of FIG. 1 is illustrated.

Another embodiment of the invention is illustrated in FIG. 3 where the game is played in a form called doubles and sevens. By doubles is meant both up faces on the thrown dice 12 must have the same digit such, for example, as one, one or four, four. The diagonal beginning with the intersection one, one and ending with six, six can only be formed with markers 14 by throwing doubles. The diagonal beginning with the intersection one, six and ending with six, one can only be developed by throwing sevens. Sevens are defined as any throw of the dice where the up faces represent the following combinations: four, three; five, two; six, one.

This invention has been described by reference to precise embodiments, but it will be appreciated by those skilled in the art that this invention is subject to various modifications and to the extent that those modifications would be obvious to one of ordinary skill they are considered as being within the scope of the appended claims.

What is claimed is:

1. An apparatus for amusement comprising a game board having horizontally and vertically disposed lines which enclose a plurality of playing areas, wherein said areas are arranged into an equal number of rows and columns, and said playing areas having a peripherally arranged indicia to identify various rows and columns of said apparatus comprising, a.) a plurality of common six-sided dies having different pips to represent various numbers;

b.) numbered indicia located in said playing areas which are consecutive along all rows and columns beginning with the numbered indicia located at an intersection of the first row and column, which has a lowest value, c.) said numbered indicia representing a summation of all visible pips appearing on said dies, d.) and the intersecting of any column and row which is abetted by said peripherally arranged indicia identifying a playing area for locating said numbered indicia, and a particular column and row being selected by upward facing pips on said dies;

e. a plurality of markers for placement on certain of said playing area indicia, and f. whereby a roll of said dies locates the row and column or, alternatively, the column and row via said upward facing pips for placement of a marker in said playing area such that a match occurs between said visible pips and said numbered summation indicia, and a player who fills a row, column, or diagonal with said markers receives a score based on a total of the numbered indicia located in said row, column, or diagonal.

2. A game apparatus in accordance with claim 1 wherein the number of rows and columns are six in number.

3. An apparatus in accordance with claim 1 wherein said plurality of standard dies are two in number.

4. An apparatus in accordance with claim 1 and further comprising, additional peripheral indicia means located at an end of said rows, columns, and diagonals which correspond to a total of the summation indicia in said playing areas.

5. An apparatus in accordance with claim 1 wherein said rows and columns are respectively six in number.

6. An apparatus in accordance with claim 1 wherein the number having a lowest values of the playing areas is thirty.

7. An apparatus in accordance with claim 1 wherein said playing areas are dimensioned as squares.

* * * * *